US010513933B2

(12) United States Patent
Mugglestone

(10) Patent No.: US 10,513,933 B2
(45) Date of Patent: Dec. 24, 2019

(54) COOLING CONCEPT FOR TURBINE BLADES OR VANES

(71) Applicant: Siemens Aktiengesellschaft, Munich (DE)

(72) Inventor: Jonathan Mugglestone, Brinsley (GB)

(73) Assignee: Siemens Aktiengesellschaft, Munich (DE)

( * ) Notice: Subject to any disclaimer, the term of this patent is extended or adjusted under 35 U.S.C. 154(b) by 312 days.

(21) Appl. No.: 15/504,358

(22) PCT Filed: Aug. 5, 2015

(86) PCT No.: PCT/EP2015/068015
§ 371 (c)(1),
(2) Date: Feb. 16, 2017

(87) PCT Pub. No.: WO2016/030157
PCT Pub. Date: Mar. 3, 2016

(65) Prior Publication Data

US 2017/0234144 A1 Aug. 17, 2017

(30) Foreign Application Priority Data

Aug. 28, 2014 (EP) ..... 14182731

(51) Int. Cl.
*F01D 5/18* (2006.01)
*F01D 9/04* (2006.01)
*F01D 25/12* (2006.01)

(52) U.S. Cl.
CPC ..... *F01D 5/187* (2013.01); *F01D 5/188* (2013.01); *F01D 5/189* (2013.01); *F01D 9/041* (2013.01);
(Continued)

(58) Field of Classification Search
CPC ..... F01D 5/187; F01D 5/188; F01D 5/189; F01D 9/041; F01D 25/12; F05D 2240/12;
(Continued)

(56) References Cited

U.S. PATENT DOCUMENTS 6,089,822 A * 7/2000 Fukuno ..... F01D 5/189 415/115
6,453,557 B1 * 9/2002 Burdgick ..... F01D 5/189 29/889.7
(Continued)

FOREIGN PATENT DOCUMENTS

CN 102224322 A 10/2011
CN 104169530 A 11/2014
(Continued)

OTHER PUBLICATIONS

RU search report dated Mar. 13, 2018, for RU patent application No. 2017105830.
(Continued)

*Primary Examiner* — Aaron R Eastman
(74) *Attorney, Agent, or Firm* — Beusse Wolters Sanks & Maire

(57) ABSTRACT

A turbine assembly with a hollow aerofoil having a main cavity with an impingement tube, insertable inside the main cavity for impingement cooling of an inner surface of the main cavity, and a platform at a radial end of the hollow aerofoil, and a cooling chamber for cooling the platform arranged relative to the hollow aerofoil on an opposed site of the platform. The cooling chamber is limited at a first radial end by a wall segment of the platform and at an opposed radial second end from a cover plate. The impingement tube extends in span wise direction through the cooling chamber from the platform to the cover plate and restricts a sub-cavity of the main cavity. The wall segment includes an entry aperture for a cooling medium to enter from the
(Continued)

cooling chamber of the platform into the sub-cavity of the hollow aerofoil.

18 Claims, 5 Drawing Sheets

(52) U.S. Cl.
CPC ..... *F01D 25/12* (2013.01); *F05D 2240/12* (2013.01); *F05D 2240/30* (2013.01); *F05D 2240/81* (2013.01); *F05D 2260/201* (2013.01); *F05D 2260/205* (2013.01)

(58) Field of Classification Search
CPC ..... F05D 2240/30; F05D 2240/81; F05D 2260/201; F05D 2260/205
USPC ..... 415/115
See application file for complete search history.

(56) References Cited

U.S. PATENT DOCUMENTS

| | | | | |
|---|---|---|---|---|
| 6,607,355 | B2 * | 8/2003 | Cunha | F01D 5/18 416/97 R |
| 6,843,637 | B1 * | 1/2005 | Pothier | F01D 9/041 415/114 |
| 8,109,724 | B2 * | 2/2012 | Malecki | F01D 5/189 416/90 R |
| 8,162,617 | B1 * | 4/2012 | Davies | F01D 5/147 416/223 R |
| 8,500,405 | B1 * | 8/2013 | Jones | F01D 9/065 415/115 |
| 2004/0265129 | A1 * | 12/2004 | Pabion | F01D 5/189 416/97 R |
| 2006/0140750 | A1 * | 6/2006 | Burdgick | F01D 5/189 415/116 |
| 2010/0313419 | A1 * | 12/2010 | Stampfli | B23P 6/005 29/889.1 |
| 2011/0123351 | A1 * | 5/2011 | Hada | F01D 5/189 416/97 R |
| 2011/0217159 | A1 * | 9/2011 | McMahan | F02C 7/12 415/115 |
| 2012/0084010 | A1 | 4/2012 | Lu et al. | |
| 2015/0030461 | A1 * | 1/2015 | Mugglestone | F01D 5/188 416/97 R |

FOREIGN PATENT DOCUMENTS

| | | | |
|---|---|---|---|
| EP | 0911486 | A2 | 4/1999 |
| EP | 1571296 | A1 | 9/2005 |
| EP | 2625519 | A1 | 8/2013 |
| EP | 2626519 | A1 | 8/2013 |
| RU | 2208683 | C1 | 7/2003 |
| RU | 2276732 | C2 | 5/2006 |
| WO | 2013117258 | A1 | 8/2013 |

OTHER PUBLICATIONS

International Search Report dated Oct. 26, 2015, for PCT/EP2015/068015.
EP Search Report dated Feb. 9, 2015, for EP patent application No. 14182731.1.
CN office action dated Nov. 16, 2017, for CN patent application No. 201580046303.

* cited by examiner

COOLING CONCEPT FOR TURBINE BLADES OR VANES

CROSS REFERENCE TO RELATED APPLICATIONS

This application is the US National Stage of International Application No. PCT/EP2015/068015 filed Aug. 5, 2015, and claims the benefit thereof. The International Application claims the benefit of European Application No. EP14182731 filed Aug. 28, 2014. All of the applications are incorporated by reference herein in their entirety.

FIELD OF THE INVENTION

The present invention relates to an aerofoil-shaped turbine assembly such as turbine rotor blades and stator vanes, and to impingement tubes used in such components for cooling purposes.

BACKGROUND TO THE INVENTION

Modern turbines often operate at extremely high temperatures. The effect of temperature on the turbine blades and/or stator vanes can be detrimental to the efficient operation of the turbine and can, in extreme circumstances, lead to distortion and possible failure of the blade or vane. In order to overcome this risk, high temperature turbines may include hollow blades or vanes incorporating so-called impingement tubes for cooling purposes.

These so-called impingement tubes are hollow tubes that run radially within the blades or vanes. Air is forced into and along these tubes and emerges through suitable apertures into a void between the tubes and interior surfaces of the hollow blades or vanes. This creates an internal air flow for cooling the blade or vane.

Normally, blades and vanes are made as precision castings having hollow structures in which impingement tubes are inserted for impingement cooling of an impingement cooling zone of the hollow structure. Problems arise when a cooling concept is used in which a temperature of a cooling medium for the impingement cooling zone is too high for efficient cooling of the latter.

This is known from a cooling concept, where a combined platform and aerofoil cooling systems are arranged in series. A compressor discharge flow feeds in the platform cooling and then passes into the aerofoil cooling system. All the cooling flow is discharged through the aerofoil. In the absence of film cooling, all the flow can be discharged through the aerofoil trailing edge.

The technical problem relates to the combined platform and aerofoil cooling system. One of the main disadvantages with such a system is the elevated cooling air temperatures supplied to the aerofoil section, resulting from the heat pickup of the platform cooling. The increase in cooling air temperature can be of the order of 50° C. When engines are significantly up-rated, the resultant coolant temperature rise through the platform cooling can be a significant factor limiting ability to achieve the required cooling levels within the aerofoil. In such situations a significant redesign of the cooling or change of cooling feed system may be required, involving a significant amount of development and production time and cost. A change of cooling feed system to an state of the art independent aerofoil/platform system can have the disadvantage of increased aerodynamic/performance losses, since more cooling air is discharged in the gas path in a less efficient manner, i.e. near the platform regions at undesired trajectories.

SUMMARY OF INVENTION

It is a first objective of the present invention to provide an advantageous aerofoil-shaped turbine assembly such as a turbine rotor blade and a stator vane with which the above described shortcomings can be can be mitigated, and especially to provide a turbine assembly that is easier and cheaper to implement in comparison with state of the art systems. A second objective of the invention is to provide a gas turbine engine comprising at least one advantageous turbine assembly.

These objectives may be solved by a turbine assembly and a gas turbine engine according to the subject-matter of the independent claims.

Accordingly, the present invention provides a turbine assembly comprising a basically hollow aerofoil having at least a main cavity with at least an impingement tube, which is insertable inside the main cavity of the hollow aerofoil and is used for impingement cooling of at least an inner surface of the main cavity, and with at least a platform, which is arranged at a radial end of the hollow aerofoil, and with at least a cooling chamber used for cooling of at least the platform and which is arranged relative to the hollow aerofoil on an opposed site of the at least one platform and wherein the at least one cooling chamber is limited at a first radial end by at least one a wall segment of the platform and at an opposed radial second end from at least a cover plate and wherein the impingement tube extends in span wise direction at least completely through the cooling chamber from the platform to the cover plate.

It is provided that the impingement tube restricts a sub-cavity of the main cavity and wherein the at least one wall segment of the at least one platform comprises at least one entry aperture for a cooling medium to enter through the at least one entry aperture from the at least one cooling chamber of the at least one platform into the sub-cavity of the hollow aerofoil.

Due to the inventive matter both a compressor discharge flow and a platform cooling flow is fed into the aerofoil, which has significant advantages in terms of cooling effectiveness and minimising gas path secondary flow aerodynamic losses. This allows the advantages of both basic cooling feed systems (combined and independent) to be combined within a single design, allowing a significant improvement in aerofoil cooling efficiency while minimising the performance losses. Specifically, in comparison to state of the art systems lower cooling feed temperatures and reduced cooling flows can be achieved, especially at an edge of the platform where in systems with separate platform cooling potentially high losses arising from cooling ejection near the platforms are caused.

Moreover, also the cooling efficiency of a pedestal region in a trailing edge region could be improved, since heat transfer coefficients can be maximised through high rates resulting from combined cooling flows. Further, an aerofoil and a platform cooling can be adjusted independently, providing good control of both cooling systems. Additionally, aerodynamic/performance losses can be minimised. With the use of such a turbine assembly, conventional state of the art precision castings of rotor blades and stator vanes could be used. Thus, the design can be retrofitted into existing combined cooling feed systems at low cost, since no changes to the casting are required. Hence, intricate and costly reconstruction of these aerofoils and changes to a casting process could be omitted. Further, this new design is cheaper and easier to implement as well as easier to manufacture than an already known multiple feed impingement tube. Consequently, an efficient turbine assembly or gas turbine engine, respectively, could advantageously be provided.

Even if a term like aerofoil, cavity, sub-cavity, impingement tube, surface, platform, chamber, wall segment, plate, aperture, cooling medium or section is used in the singular or in a specific numeral form in the claims and the specification the scope of the patent (application) should not be restricted to the singular or the specific numeral form. It should also lie in the scope of the invention to have more than one or a plurality of the above mentioned structure(s).

A turbine assembly is intended to mean an assembly provided for a turbine, like a gas turbine engine, wherein the assembly possesses at least an aerofoil. Advantageously, the turbine assembly has a turbine cascade and/or turbine wheel with circumferential arranged aerofoils and/or an outer and an inner platform arranged at opponent ends of the aerofoil(s). In this context a "basically hollow aerofoil" means an aerofoil with a casing, wherein the casing encases at least one main cavity. A structure, like a rib, rail or partition, which divides different cavities in the aerofoil from one another and for example extends in a span wise direction of the aerofoil, does not hinder the definition of "a basically hollow aerofoil". Advantageously, the aerofoil is hollow. In particular, the basically hollow aerofoil, referred as aerofoil in the following description, has two cooling regions, an impingement cooling region at a leading edge of the aerofoil and a state of the art pin-fin/pedestal cooling region at the trailing edge. These regions could be separated from one another through a rib.

In this context an impingement tube is a piece that is constructed independently from the aerofoil and/or is another piece then the aerofoil and/or isn't formed integrally with the aerofoil. The phrase "which is insertable inside the main cavity of the hollow aerofoil" is intended to mean that the impingement tube is inserted into the main cavity of the aerofoil during an assembly process of the turbine assembly, especially as a separate piece from the aerofoil. The aerofoil cooling is generally supplied via the cooling impingement tube within the aerofoil which is inserted through one aperture of the platform or in case of a construction with two opposed arranged platforms the impingement tube is inserted through both of such apertures within the platforms. Moreover, the phrase "is used for impingement cooling" is intended to mean that the impingement tube is intended, primed, designed and/or embodied to mediate a cooling via an impingement process. An inner surface of the main cavity defines in particular a surface which faces an outer surface of the impingement tube.

A platform is intended to mean a region of the turbine assembly which confines at least a part of a cavity and in particular, a main cavity of the aerofoil. Moreover, the platform is arranged at a radial end of the hollow aerofoil, wherein a radial end defines an end which is arranged with a radial distance from an axis of rotation of the turbine assembly or a spindle, respectively. The platform could be a region of the casing of the aerofoil or a separate piece attached to the aerofoil. The platform may be an inner platform and/or an outer platform and is advantageously the outer platform. Furthermore, the platform is oriented basically perpendicular to a span wise direction of the hollow aerofoil. In the scope of an arrangement of the platform as "basically perpendicular" to a span wise direction should also lie a divergence of the platform in respect to the span wise direction of about 45°. Advantageously, the platform is arranged perpendicular to the span wise direction. A span wise direction of the hollow aerofoil is defined as a direction extending basically perpendicular, advantageously perpendicular, to a direction from the leading edge to the trailing edge of the aerofoil, the latter direction is also known as a chord wise direction of the hollow aerofoil. In the following text this direction is referred to as the axial direction.

A cooling chamber is intended to mean a cavity in that cooling medium may be fed, stored and/or induced for the purpose of cooling of side walls of the cavity and especially of a platform. A wall segment of the platform should be understood as a wall separating the cooling chamber of the platform from the main cavity of the aerofoil and that restricts the main cavity in radial direction or in span wise direction. It extends basically perpendicular, advantageously perpendicular, to the span wise direction of the aerofoil.

In this context a cover plate is intended to mean a plate, a lid, a top or any other device suitable for a person skilled in the art, which basically covers the cooling chamber. The term "basically covers" is intended to mean that the cover plate does not hermetically seals the cooling chamber. Thus, the cover plate may have holes to provide access for the cooling medium into the cooling chamber. Advantageously, the cover plate is an impingement plate. The term "limit" should be understood as "border", "terminate" or "confine". In other words the platform and the cover plate borders the cooling chamber. Moreover, the cover plate is basically arranged in parallel and advantageously arranged in parallel to the wall segment of the platform.

In this context the term that the impingement tube "restricts" a sub-cavity of the main cavity should be understood as "separating the sub-cavity from the main cavity" or "as dividing the main cavity in the part housing the impingement tube and the sub-cavity without an impingement tube or any other insert". Thus the sub-cavity is a basically free space allowing the cooling medium to flow freely through the sub-cavity, basically from a leading edge side to the trailing edge. An entry aperture is intended to mean an aperture, orifice, clearance or hole that provides a passage for a cooling medium to enter from the at least one cooling chamber of the platform into the sub-cavity of the hollow aerofoil.

Advantageously, the hollow aerofoil comprises a single cavity. But the invention could also be realized for a hollow aerofoil comprising two or more cavities each of them accommodating an impingement tube according to the invention and/or being a part of the pin-fin/pedestal cooling region. In this context the impingement tube located in its position nearest to the trailing edge would be the impingement tube restricting/separating the sub-cavity from the main cavity, which houses the impingement tube(s).

As stated above, the hollow aerofoil comprises a trailing edge and a leading edge. In an embodiment the impingement tube is located towards the leading edge of the hollow aerofoil. This results in an efficient cooling of this region and advantageously in minimised aerofoil cooling feed temperatures in respect to state of the art systems. The low temperature compressor discharge flow is fed directly to the aerofoil leading edge region where the highest cooling effectiveness is required. Due to the thus increased impingement cooling effectiveness throughout the entire impingement region and at the leading edge, less cooling flow will be required compared to state of the art systems. In addition to the performance benefits, this reduction in cooling flow within the leading edge region has the effect of increasing the cooling effectiveness on the downstream impingement regions due to the reduced cross flow effects. Further, the sub-cavity is located viewed in direction from the leading edge to the trailing edge downstream of the impingement tube or in other words located more towards the trailing edge of the hollow aerofoil than the impingement tube. Thus, the platform cooling flow is directed to provide cooling at the more downstream regions of the aerofoil.

The impingement tube is provided with impingement holes. Consequently, a merged stream of cooling medium from the impingement tube, the cooling chamber of the platform and from the sub-cavity may pass through the non-impingement pin-fin/pedestal cooling region. The heat transfer coefficients within the pin-fin/pedestal cooling region are advantageously maximised because of the high flow rates resulting from the combined cooling flows. Potentially, the merged stream can exit through the aerofoil trailing edge. Therefore, the trailing edge has exit apertures to allow the merged stream to exit the hollow aerofoil. Due to this a most effective ejection can be provided. Hence, the aerodynamic/performance losses can be minimised in respect to state of the art systems. In these state of the art systems a cooling of the platform and the aerofoil is performed independently from each other with no flow connection between the platform and the aerofoil. For a discharge of the cooling medium these systems need additional exit apertures near the platform which results in discharge of more cooling medium, especially in a less efficient manner in respect to the inventive construction. Thus, high losses can arise with such state of the art cooling ejection near the platform.

In a refinement of the invention it is provided that the at least one entry aperture in the at least one wall segment of the at least one platform is covered by an orifice plate for controlling a flow of the cooling medium into the sub-cavity. This additional orifice plate allows much greater control of the platform cooling system. Although the platform cooling flow system can be largely controlled by the holes in the cover plate of the platform cooling system (providing that the leakages are minimised), in some cases the restriction necessary can significantly impede the definition of the impingement hole array in the cover plate for the platform cooling, where a good coverage of holes is generally required. This is because the impingement cooling hole size and number may have to be significantly minimised, which can dramatically reduce the overall platform cooling effectiveness. The additional orifice plate eliminates this limitation allowing a more even platform cooling distribution; it can also provide an additional flow control when leakage flows around the platform cover plate/impingement plate are high.

An "orifice plate" is intended to mean a plate with a single or an array of holes that are selectively selected in distribution, size or shape to purposefully influence the flow of the cooling medium through it. In this context the term "cover" should be understood as "located over" or "located in" or "located beneath". Thus, an axial extension of the orifice plate may have the same size or clearance than that of the entry aperture or it may be axially wider than the entry aperture. The later solution would additionally provide a fastening possibility by the positioning of the orifice plate on a rim of the entry aperture or the wall segment of the platform.

A further realisation of the invention provides that the at least one entry aperture in the at least one wall segment of the at least one platform is an insertion aperture through which the impingement tube extends from the at least one cooling chamber of the at least one platform to the main cavity of the hollow aerofoil. In other words, the entry aperture providing the passage for the cooling medium from the cooling chamber of the platform to the sub-cavity and the insertion aperture for the impingement tube is the same clearance in the wall segment of the platform. Or the impingement tube is located in such a way in the turbine assembly or the platform and the main cavity as to leave a clearance towards the rear (in direction from the leading edge to the trailing edge) of the insertion aperture in the wall segment of the platform. Consequently further machining of a separate hole can be omitted, saving manufacturing efforts, costs and time. Further a state of the art cooling system can be quickly retrofitted to the new design.

According to an alternative embodiment of the invention it is provided that the at least one entry aperture in the at least one wall segment of the at least one platform is a separate entry aperture from an insert aperture through which the impingement tube extends from the at least one cooling chamber of the at least one platform to the main cavity of the hollow aerofoil. This has the advantage of being cheaper and easier to implement in comparison with state of the art systems. Moreover, The wall segment has more stability by adding just one smaller orifice in comparison with the construction comprising the clearance from the insert aperture of the impingement tube. Further, a standard impingement tube design (i.e. fully fitting the insert aperture in the platform) can be used in combination with the additional orifice/entry aperture through in the wall segment of the platform. This also ensures a proper positioning of the impingement tube in the insertion aperture.

Thus, the here described multi-feed aerofoil cooling system uses multiple cooling inlets within the platforms, either by subdividing the impingement tube platform insert aperture or by using an additional flow paths through the platform.

Furthermore, it is advantageous when the turbine assembly possesses at least a further platform. The features described in this text for the first mentioned platform could be also applied to the at least further platform. The platform and the at least further platform are arranged at opposed radial ends of the hollow aerofoil. Moreover, the impingement tube may terminate at the platform or advantageously, at the at least further platform. Due to this, the cooling chamber or an at least further cooling chamber of the at least further platform can be realised as an unblocked space, hence a velocity of a cross flow of used impingement cooling medium could be maintained low and the impingement cooling may be more effective in comparison with a blocked cooling chamber. Further, the proper arrangement of the sections inside the aerofoil during assembly can be ensured.

In an advantageous embodiment the impingement tube ends at the cover plate in a hermetically sealed manner. Thus, a leakage between the impingement tube and the cooling chamber is efficiently prevented. The term "end" should be understood as "finish" or "stop". Advantageously, the impingement tube extends substantially completely through a span of the hollow aerofoil resulting in a powerful cooling of the aerofoil. But it is also conceivable that the impingement tube would extend only through a part of the span of the hollow aerofoil.

Moreover, the at least further cooling chamber of the at least further platform is used for cooling the latter and is arranged relative to the hollow aerofoil on an opposed site of the at least further platform and wherein the at least further cooling chamber is limited at a first radial end by at least a further wall segment from the at least further platform and at the opposed radial second end from at least a further cover plate. Advantageously, the at least further wall segment of the further platform comprises at least one further entry aperture for a cooling medium to enter through the at least one further aperture from the further cooling chamber of the further platform into the sub-cavity of the hollow aerofoil. Thus, the cooling can be performed especially efficiently by feeding it from two opposed sides into the sub-cavity.

Advantageously, the impingement tube is sealed in respect to the at least further cooling chamber. Due to this, the compressor discharge flow entering the impingement tube from the side of the platform is unhindered by a contrariwise flow of cooling medium, entering from the impingement tube from the side of the at least further platform. The at least further platform covers the impingement tube in a hermetically sealed manner, thus saving an additional sealing means.

Alternatively, it may be possible, that the impingement tube extends in span wise direction at least completely through the at least further cooling chamber from the at least further platform to the at least further cover plate, hence ensuring a sufficient feed of cooling medium into the impingement tube. Further, the impingement tube could end both at the cover plate and at the at least further cover plate in a hermetically sealed manner, providing a leakage free feeding of cooling medium.

Generally, it would be possible that the impingement tube being formed from at least two separate pieces. To use a two or more piece impingement tube allows characteristics of the pieces, like material, material thickness or any other characteristic suitable for a person skilled in the art, to be customised to the cooling function of the piece. Furthermore, the at least two separate pieces are formed from a leading piece and a trailing piece, wherein in particular the leading piece is located towards the leading edge of the hollow aerofoil and the trailing piece is located viewed in direction from the leading edge to the trailing edge downstream of the leading piece or in other words located more towards the trailing edge of the hollow aerofoil than the leading piece. Through this advantageous arrangement the leading piece and thus the fresh unheated compressor discharge flow is efficiently used for the direct cooling of the leading edge—the region of the aerofoil where the highest cooling effectiveness is required. After the trailing piece the sub-cavity would be located.

But it is also conceivable that the impingement tube being formed from three separate pieces, particularly as a leading, a middle and a trailing piece of the impingement tube, wherein the leading piece, which extends in span wise direction at least completely through the cooling chamber from the platform to the cover plate, could be located towards the leading edge of the hollow aerofoil, the middle piece could be located in a middle of the hollow aerofoil or the cavity thereof, respectively, and/or the trailing piece could be located towards a trailing edge of the hollow aerofoil.

For example, each of the separate pieces extends substantially completely through the span of the hollow aerofoil resulting in an effective cooling of the aerofoil. But it is also conceivable that at least one of the separate pieces would extend only through a part of the span of the hollow aerofoil.

In an alternative embodiment the impingement tube has at least one communicating apertures to allow a flow communication of cooling medium between the impingement tube and the sub-cavity. Due to this construction, a bypass could be provided, by means of which a fraction of the cooling medium may avoid to eject through the impingement holes of the impingement tube. Hence, cooling medium with a low temperature can enter the sub-cavity for efficient cooling of the latter. There may be a plurality of communicating apertures.

To provide the turbine assembly with good cooling properties and a satisfactory alignment of the impingement tube in the aerofoil, the hollow aerofoil comprises at least a spacer at the inner surface of the cavity of the hollow aerofoil to hold the impingement tube at a predetermined distance to said surface of the hollow aerofoil. The spacer is advantageously embodied as a protrusion or a locking pin or a rib for easy construction and a straight seat of the impingement tube.

In a further advantageous embodiment the hollow aerofoil is a turbine blade or vane, for example a nozzle guide vane.

In an alternative or further embodiment one cover plate and/or one cooling chamber may feed more than one aerofoil i.e. the stator vanes are constructed as segments comprising e g two or more aerofoils.

In a further advantageous embodiment of the invention it is provided that the at least one cover plate of the at least one cooling chamber of the at least one platform is divided by the impingement tube in at least two sections. Thus, properties of the cover plate, like a pattern of an array of impingement holes or a thickness of the cover plate may be specifically selected in respect of its position in reference to the impingement tube or the entry aperture or additional feature like the orifice plate.

According to the inventive embodiment the turbine assembly is being cooled by a first stream of cooling medium which is fed to the impingement tube and by a second stream of cooling medium which is fed first to the at least one cooling chamber and thereafter through the at least one entry aperture to the sub-cavity in series. Advantageously, this results in minimised aerofoil cooling feed temperatures and thus in a higher impingement cooling effectiveness throughout the entire impingement region compared to state of the art systems. The first stream is advantageously taken directly from the compressor discharge flow and the second stream the spent platform cooling flow. The term "in series" is intended to mean that the second stream passes the cooling chamber and the sub-cavity specially and/or chronologically one after the other.

Thus the cool compressor discharge air is fed directly into aerofoil impingement cooling region, via the impingement tube. The platform cooling flow is fed through the cover/impingement plate, and then enters the aerofoil sub-cavity though the entry aperture/orifice towards the rear of the impingement tube or the additional entry aperture. The flows from both cooling systems are combined within the aerofoil towards the trailing edge.

Further, the turbine assembly is used for cooling of the basically hollow aerofoil, wherein the first stream of cooling medium is directly fed to the impingement tube and the second stream of the cooling medium is fed to the at least one cooling chamber and/or the at least further cooling chamber and thereafter to the sub-cavity in series.

The invention further refers to a gas turbine engine comprising a plurality of turbine assemblies, wherein at least one of the turbine assemblies is arranged such as explained before.

Due to the inventive matter both a compressor discharge flow and a platform cooling flow is fed into the aerofoil, which has significant advantages in terms of cooling effectiveness and minimising gas path secondary flow aerodynamic losses. This allows the advantages of both basic cooling feed systems (combined and independent) to be combined within a single design, allowing a significant improvement in aerofoil cooling efficiency while minimising the performance losses. Specifically, in comparison to state of the art systems lower cooling feed temperatures and reduced cooling flows can be achieved, especially at an edge of the platform where in systems with separate platform cooling potentially high losses arising from cooling ejection near the platforms are caused.

Moreover, also the cooling efficiency of a pedestal region in a trailing edge region could be improved, since heat transfer coefficients can be maximised through high rates resulting from combined cooling flows. Further, an aerofoil and a platform cooling can be adjusted independently, providing good control of both cooling systems. Additionally, aerodynamic/performance losses can be minimised. With the use of such a turbine assembly, conventional state of the art precision castings of rotor blades and stator vanes could be used. Thus, the design can be retrofitted into existing combined cooling feed systems at low cost, since no changes to the casting are required. Hence, intricate and costly reconstruction of these aerofoils and changes to a casting process could be omitted. Further, this new design is cheaper and easier to implement as well as easier to manufacture than an already known multiple feed impingement tube. Consequently, an efficient turbine assembly or gas turbine engine, respectively, could advantageously be provided.

The above-described characteristics, features and advantages of this invention and the manner in which they are achieved are clear and clearly understood in connection with the following description of exemplary embodiments which are explained in connection with the drawings.

BRIEF DESCRIPTION OF THE DRAWINGS

The present invention will be described with reference to drawings in which.

DETAILED DESCRIPTION OF THE ILLUSTRATED EMBODIMENTS

In the present description, reference will only be made to a vane, for the sake of simplicity, but it is to be understood that the invention is applicable to both blades and vanes of a gas turbine engine. The terms upstream and downstream refer to the flow direction of the airflow and/or working gas flow through the engine 64 unless otherwise stated. If used, the terms axial, radial and circumferential are made with reference to a rotational axis 74 of the engine 64.

Figure 1:
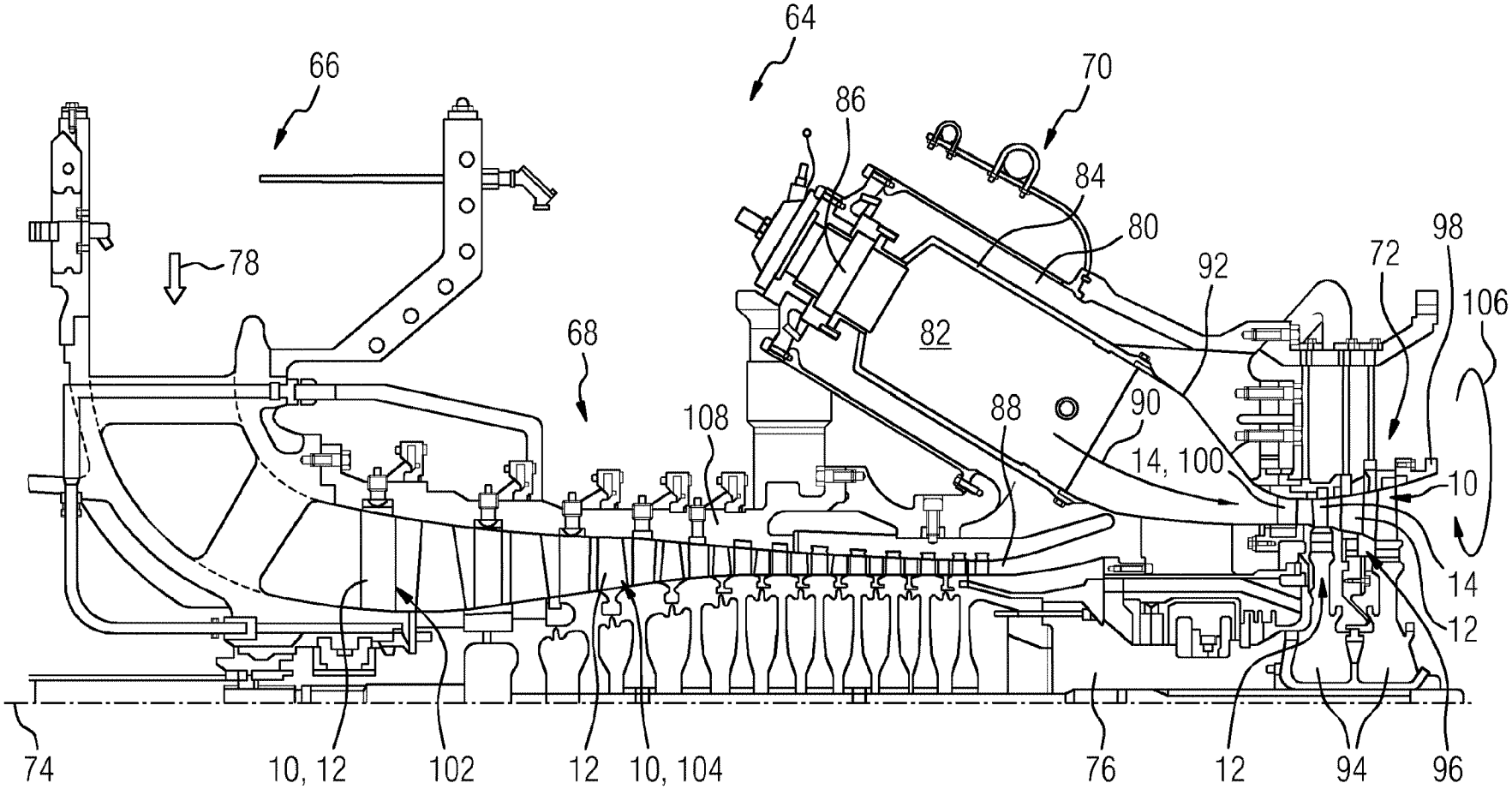
FIG. 1: shows a schematically and sectional view of a gas turbine engine comprising several inventive turbine assemblies.

FIG. 1 shows an example of a gas turbine engine 64 in a sectional view. The gas turbine engine 64 comprises, in flow series, an inlet 66, a compressor section 68, a combustion section 70 and a turbine section 72, which are generally arranged in flow series and generally in the direction of a longitudinal or rotational axis 74. The gas turbine engine 64 further comprises a shaft 76 which is rotatable about the rotational axis 74 and which extends longitudinally through the gas turbine engine 64. The shaft 76 drivingly connects the turbine section 72 to the compressor section 68.

In operation of the gas turbine engine 64, air 78, which is taken in through the air inlet 66 is compressed by the compressor section 68 and delivered to the combustion section or burner section 70. The burner section 70 comprises a burner plenum 80 one or more combustion chambers 82 defined by a double wall can 84 and at least one burner 86 fixed to each combustion chamber 82. The combustion chambers 82 and the burners 86 are located inside the burner plenum 80. The compressed air passing through the compressor section 68 enters a diffuser 88 and is discharged from the diffuser 88 into the burner plenum 80 from where a portion of the air enters the burner 86 and is mixed with a gaseous or liquid fuel. The air/fuel mixture is then burned and the combustion gas 90 or working gas from the combustion is channelled via a transition duct 92 to the turbine section 72.

The turbine section 72 comprises a number of blade carrying discs 94 or turbine wheels attached to the shaft 76. In the present example, the turbine section 72 comprises two discs 94 each carry an annular array of turbine assemblies 10, which each comprises a basically hollow aerofoil 12 embodied as a turbine blade. However, the number of blade carrying discs 94 could be different, i.e. only one disc 94 or more than two discs 94. In addition, turbine cascades 96 are disposed between the turbine blades. Each turbine cascade 96 carries an annular array of turbine assemblies 10, which each comprises a basically hollow aerofoil 12 in the form of guiding vanes, which are fixed to a stator 98 of the gas turbine engine 64. Between the exit of the combustion chamber 82 and the leading turbine blades inlet guiding vanes or nozzle guide vanes 100 are provided.

The combustion gas 90 from the combustion chamber 82 enters the turbine section 62 and drives the turbine blades which in turn rotate the shaft 76. The guiding vanes 100 serve to optimise the angle of the combustion or working gas 90 on to the turbine blades. The compressor section 68 comprises an axial series of guide vane stages 102 and rotor blade stages 104 with turbine assemblies 10 comprising aerofoils 12 or turbine blades or vanes 100, respectively. In circumferential direction 106 around the turbine assemblies 10 the turbine engine 64 comprises a stationary casing 108.

Figure 2:
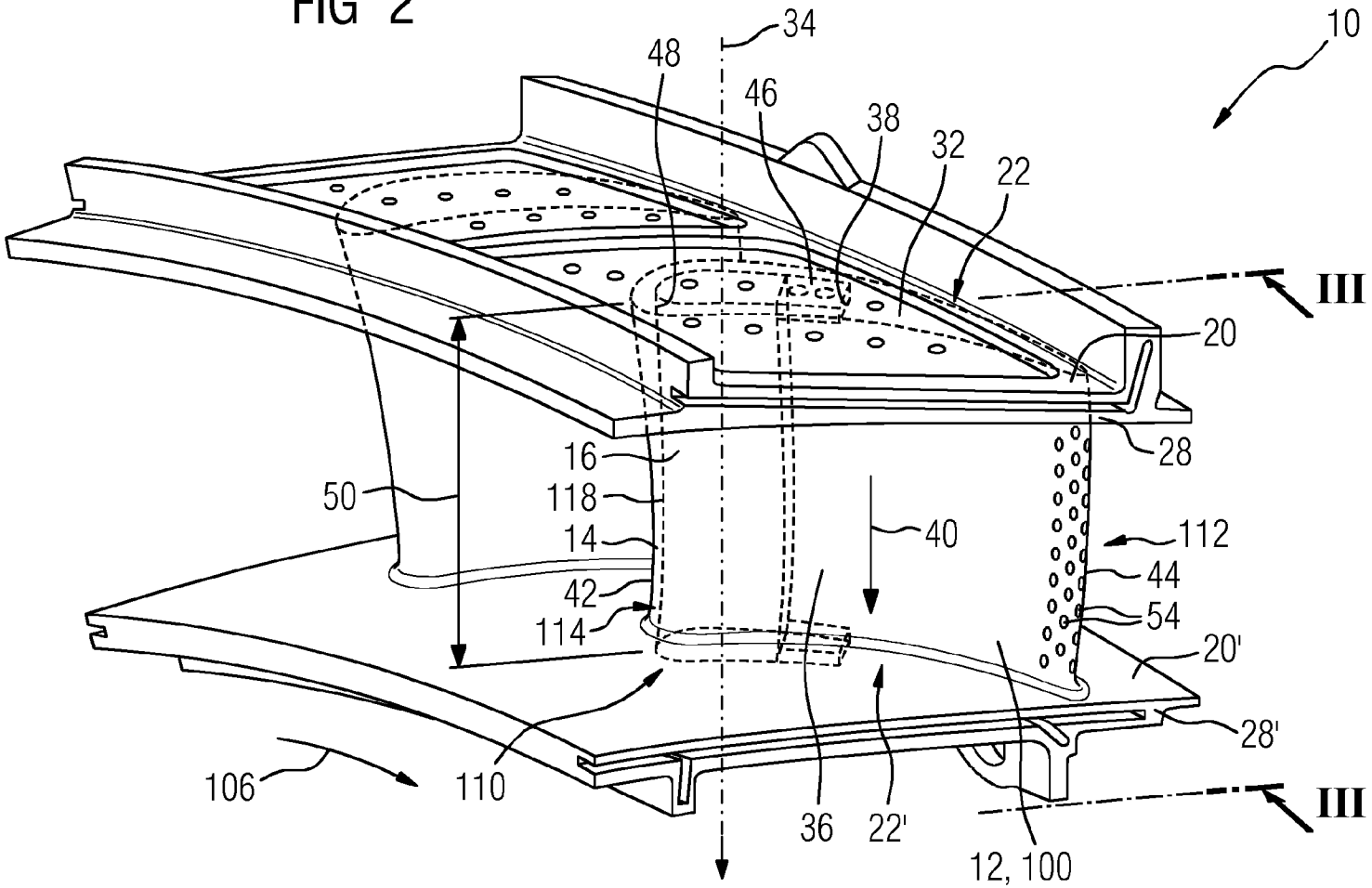
FIG. 2: shows a perspective view of a turbine assembly with an impingement tube inserted into an aerofoil of the gas turbine engine of FIG. 1 with an entry aperture in a wall segment of a platform.

FIG. 2 shows in a perspective view a turbine assembly 10 of the gas turbine engine 64. The turbine assembly 10 comprises a basically hallow aerofoil 12, embodied as a nozzle guide vane 100, with two cooling regions, specifically, an impingement cooling region 110 and a fin-pin/pedestal cooling region 112. The former is located at a leading edge 42 and the latter at a trailing edge 44 of the aerofoil 12. At two radial ends 22, 22' of the hollow aerofoil 12, which are arranged opposed towards each other at the aerofoil 12, a platform and a further platform, referred to in the following text as an outer platform 20 and an inner platform 20', are arranged. The radial location is defined with the radial direction which in turn is defined in respect to an axis of rotation of the shaft 76 arranged in a known way in the gas turbine engine 64. The outer and the inner platform 20, 20' both comprise a wall segment 28, 28', which are oriented basically perpendicular to a span wise direction 34 of the aerofoil 12. Each wall segment 28, 28' has an insertion aperture 48, which provides access to the aerofoil 12 (only the insertion aperture of wall segment 28 could be seen in FIG. 2). In a circumferential direction 106 of a not shown turbine wheel several aerofoils 12 could be arranged, wherein all aerofoils 12 where connected through the inner and the outer platforms 20, 20' with one another.

Figure 3:
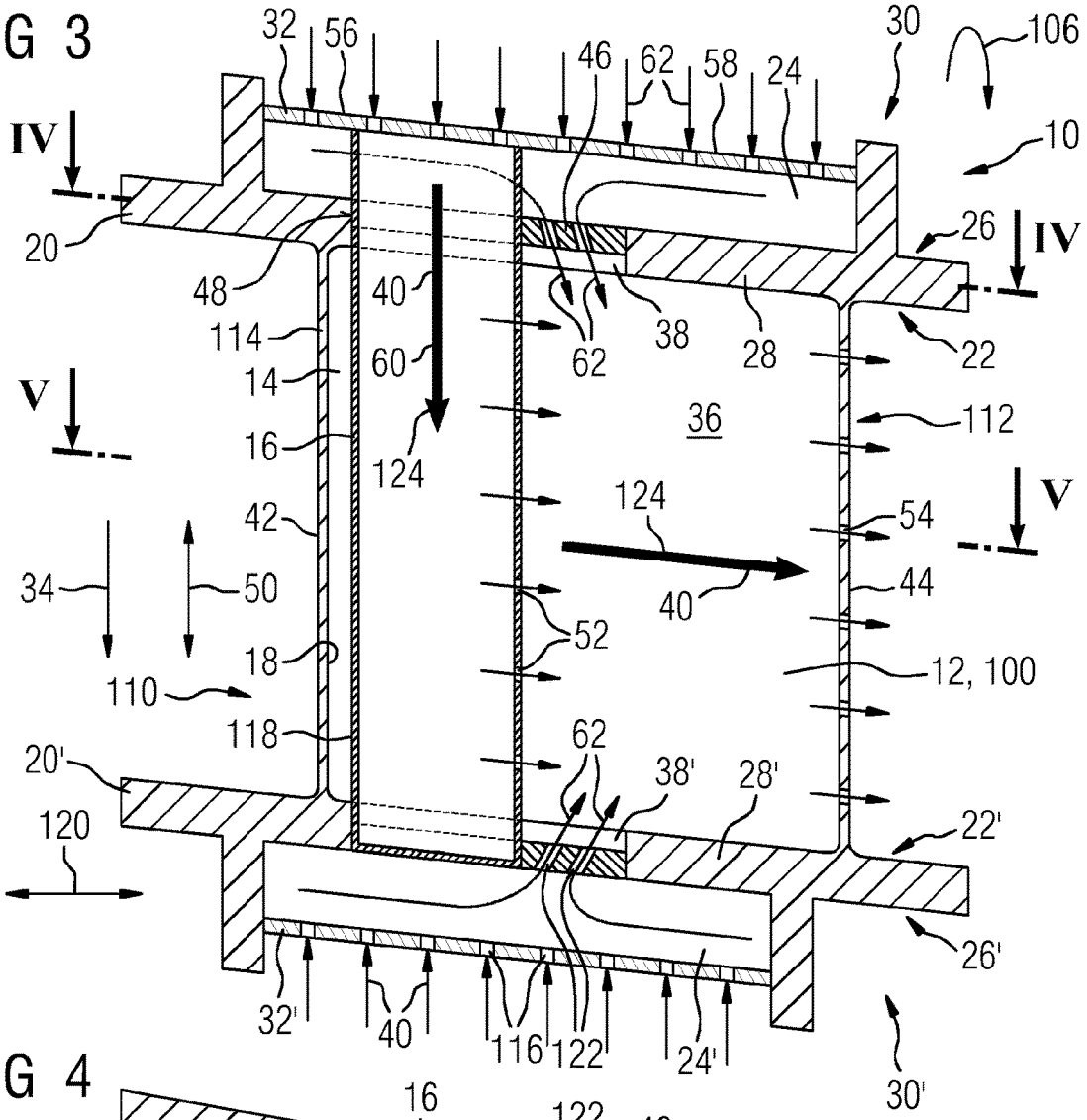
FIG. 3 shows a cross section through a turbine assembly along line III-III in FIG. 2, FIG. 4: shows a cross section through the aerofoil along line IV-IV in FIG. 3, FIG. 5: shows a cross section through the aerofoil along line V-V in FIG. 3, FIG. 6: shows a cross section through a first alternative turbine assembly with a alternatively embodied entry aperture.

As could be seen in FIG. 3 that shows a cross section of the turbine assembly 10 along line III-III in FIG. 2, the outer platform 20 and the inner platform 20' each comprises at least one cooling chamber 24, 24' referred in the following text as first cooling chamber 24 and a further second cooling chamber 24'. The first and second cooling chambers 24, 24' are used for cooling of the outer and the inner platforms 20, 20' and are arranged relative to the hollow aerofoil 12 on opposed sites of the outer and the inner platforms 20, 20' or their wall segments 28, 28'. The wall segment 28, 28' of the platform 20, 20' is a wall separating the cooling chamber 24, 24' of the platform 20, 20' from the main cavity 14 of the aerofoil 12 (see below). Thus the wall segment 28, 28' restricts the main cavity 14 in radial direction. It extends basically perpendicular, advantageously perpendicular, to the span wise direction 34 of the aerofoil 12.

Both cooling chambers 24, 24' are limited at a first radial end 26, 26' by the wall segment 28, 28' of the outer or the inner platform 20, 20' and at an opposed radial second end 30, 30' by a cover plate, referred in the following text as first cover plate 32 and a further second cover plate 32'. The first and second cover plates 32, 32' are embodied as impingement plates and have impingement holes 116 to provide access for a cooling medium 40 into the first and second cooling chambers 24, 24'.

A casing 114 of the aerofoil 12 comprises or forms a main cavity 14 spanning the aerofoil 12 in span wise direction 34, wherein the cavity 14 is located in the region of the leading edge 42 or the impingement cooling region 110, respectively. Arranged inside the main cavity 14 is an impingement tube 16, which is inserted via the insertion aperture 48 inside the main cavity 14 during assembly of the turbine assembly 10 for cooling purpose. The impingement tube 16 is used for impingement cooling of an inner surface 18 of the main cavity 14, wherein the inner surface 18 faces an outer surface 118 of the impingement tube 16. The impingement tube 16 extends in span wise direction 34 completely through the cooling chamber 24 from the cover plate 32 to the first platform 20 and it extends in span wise direction 18 along a whole span 50 of the main cavity 14 of the aerofoil 12.

Moreover, the impingement tube 16 ends at the first cover plate 32 in a hermetically sealed manner, thus preventing a leakage of cooling medium 40 from the impingement tube 16 into the first cooling chamber 24. At the opposed radial end the impingement tube 16 ends or terminates at the further wall segment 28' of the inner platform 20' (nor specifically shown) or is sealed via a sealing means, like a lid, in respect to the second cooling chamber 24'. Thus, an entry of cooling medium 40 from the cooling chamber 24' of the inner platform 20' into the impingement tube 16 is prevented.

The inserted impingement tube 16 is located towards or more precisely at the leading edge 42 or is inserted in such a way inside the main cavity 14 to restrict a sub-cavity 36 of the main cavity 14. The sub-cavity 36 is located viewed in axial direction 120—from the leading edge 42 to the trailing edge 44—downstream of the impingement tube 16 or more towards the trailing edge 44 than the impingement tube 16.

Figure 4:
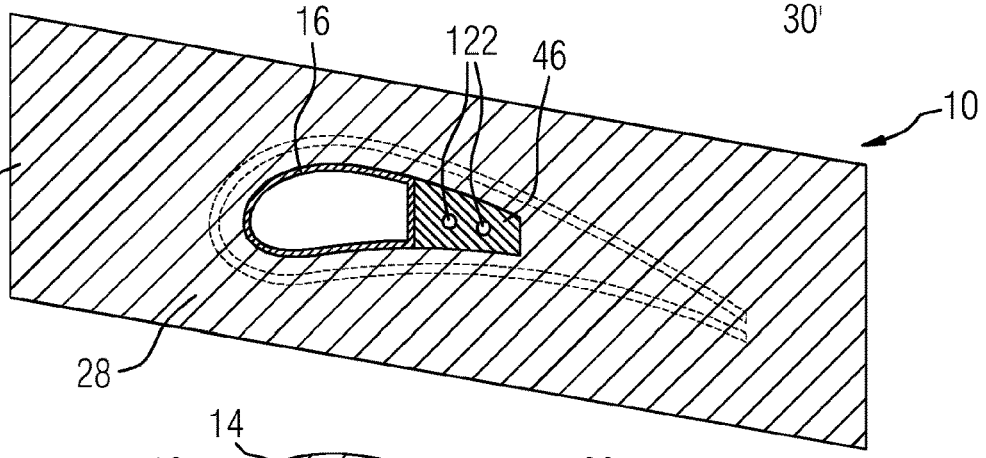
Figure 5:
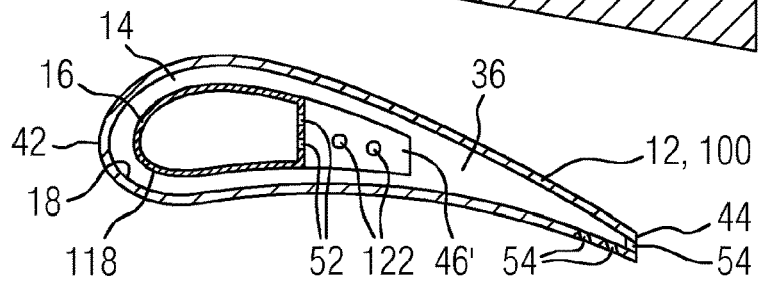

Furthermore, the wall segments 28, 28' of the outer and the inner platform 20, 20' each comprises an entry aperture 38, 38' for the cooling medium 40 to enter through the entry aperture 38, 38' from the cooling chambers 24, 24' of the platforms 20, 20' into the sub-cavity 36 of the hollow aerofoil 12. The entry apertures 38, 38' in the wall segments 28, 28' is a section or clearance of the insertion aperture 48 through which the impingement tube 16 is inserted during assembly or through which it extends from the cooling chambers 24 to the main cavity 14. To control the flow of the cooling medium 40 into the sub-cavity 36 the entry apertures 38, 38' in the wall segments 28, 28' are covered by an orifice plate 46 with an orifice 122, which can be seen in FIG. 4 that shows a cross section through the aerofoil 12 along line IV-IV in FIG. 3. A cross section through the aerofoil 14 along line V-V in FIG. 3 is shown in FIG. 5.

Moreover, to allow the cooling medium 40 traveling the impingement tube 16 to exit the impingement tube 16 it has communicating apertures 52 to allow a flow communication of cooling medium 40 between the impingement tube 16, and the sub-cavity 36.

During an operation of the turbine assembly 10 the impingement tube 16 provides a flow path 124 for the cooling medium 40, for example air. A compressor discharge flow is fed as a first stream 60 of cooling medium 40 from the compressor section 68 to the impingement tube 16 and as a second stream 62 via the impingement holes 116 of the first and second cover plate 32, 32' into the first and second cooling chambers 24, 24'. The second stream 62 of cooling medium 40 from the first and second cooling chambers 24, 24' is then discharged into sub-cavity 36 as a platform cooling flow. Thus, the turbine assembly 10 is being cooled by a first stream 60 of cooling medium 40 which is fed to the impingement tube 16 and by a second stream 62 of cooling medium 40 which is fed first to the first and second cooling chambers 24, 24' and thereafter to the sub-cavity 36 in series.

For ejection of the cooling medium 40 from the impingement tube 16 to cool the inner surface 18 of the main cavity 14 it comprise not specifically shown impingement holes. The ejected streams of cooling medium 40 from the cooling chambers 24, 24' and from the impingement tube 16 merge in a space between the outer surface 118 of the impingement tube 16 and the inner surface 18 of the main cavity 14 as well as in the sub-cavity 36. This merged stream flows to the pin-fin/pedestal cooling region 112 located at the trailing edge 44 and exits the hollow aerofoil 12 through exit apertures 54 in the trailing edge 44 (see also FIG. 2).

It may be possible to divide the cover plate 32 of the cooling chamber 24 of the platform 20 by the impingement tube 16 in at least two sections 56, 58 to choose selected properties to influence flow patterns of the flow of cooling medium 40.

In FIGS. 6 to 9 alternative embodiments of the turbine assembly 10 and the impingement tube 16 are shown. Components, features and functions that remain identical are in principle substantially denoted by the same reference characters. To distinguish between the embodiments, however, the letters "a" and "b" has been added to the different reference characters of the embodiment in FIGS. 6 to 9. The following description is confined substantially to the differences from the embodiment in FIGS. 1 to 5, wherein with regard to components, features and functions that remain identical reference may be made to the description of the embodiment in FIGS. 1 to 5.

Figure 6:
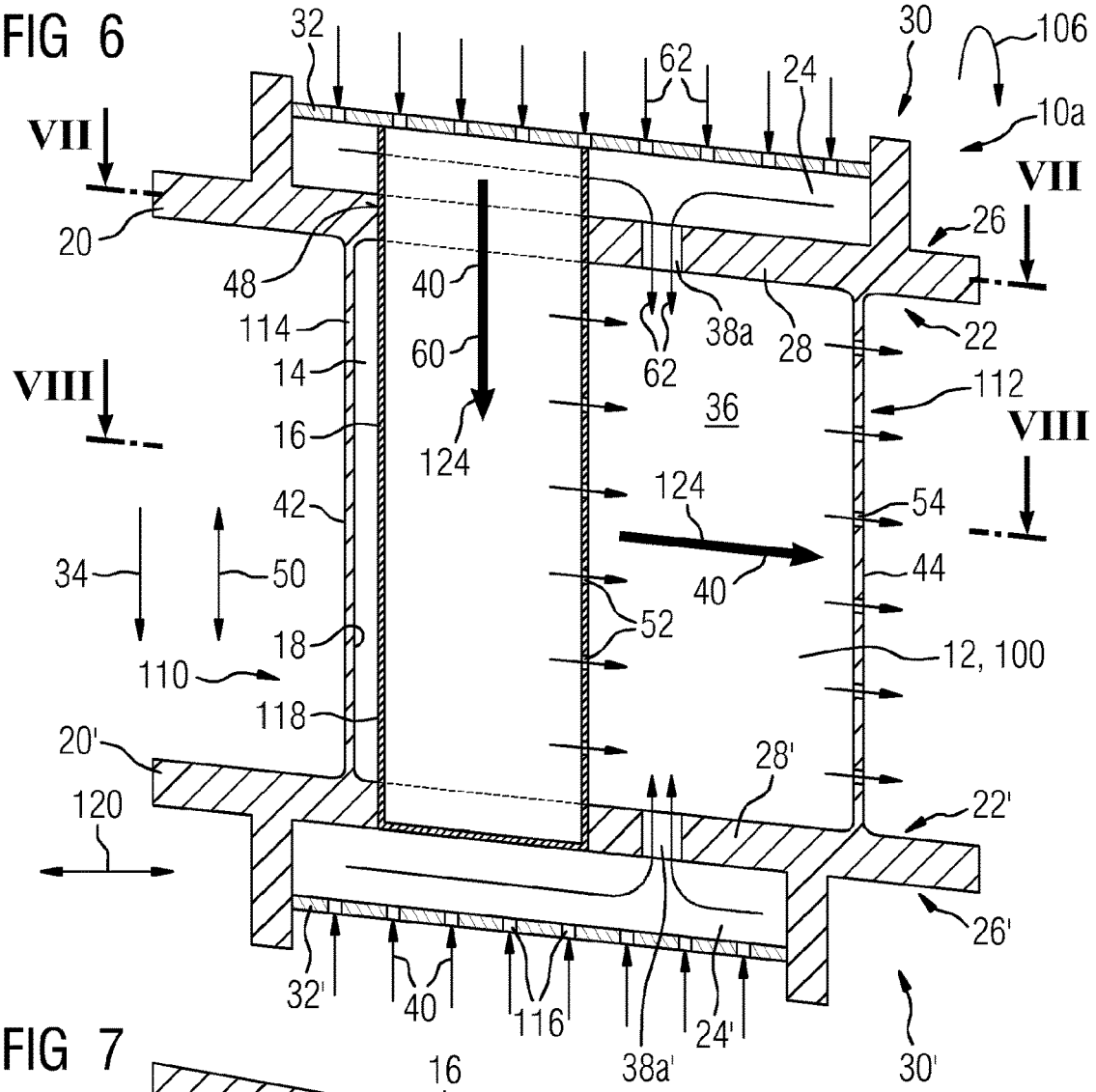
Figure 7:
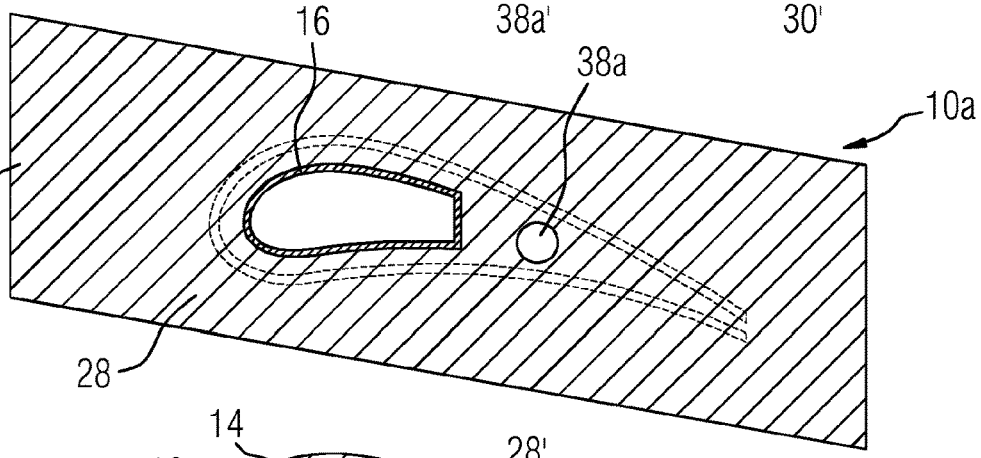
FIG. 7: shows a cross section through the aerofoil along line VII-VII in FIG. 6, FIG. 8: shows a cross section through the aerofoil along line VIII-VIII in FIG. 6 and FIG. 9: shows a cross section through a second alternative turbine assembly with an alternatively embodied impingement tube.
Figure 8:
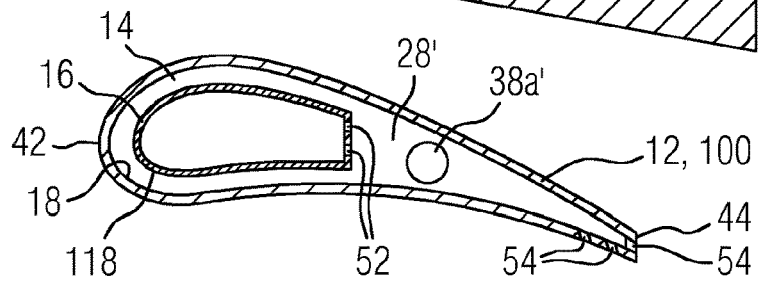

In FIG. 6 a cross section through an alternatively embodied turbine assembly 10*a* is shown. The embodiment from FIG. 6 differs in regard to the embodiment according to FIGS. 1 to 5 in that FIG. 6 shows a turbine assembly 10*a* with separately embodied entry apertures 38*a*, 38*a*'. The entry apertures 38*a*, 38*a*' in wall segments 28, 28' of inner and outer platforms 20, 20' are separate entry apertures 38*a*, 38*a*' from an insert aperture 48 through which the impingement tube 16 is inserted or through which the impingement tube 16 extends in the assembled state from a cooling chamber 24 of the platform 20 to the main cavity 14 of the hollow aerofoil 12. The arrangement of the separate entry aperture 30 is shown in FIG. 7 that shows a cross section through the aerofoil along line VII-VII in FIG. 6. A cross section through the aerofoil 14 along line VIII-VIII in FIG. 6 is shown in FIG. 8.

Figure 9:
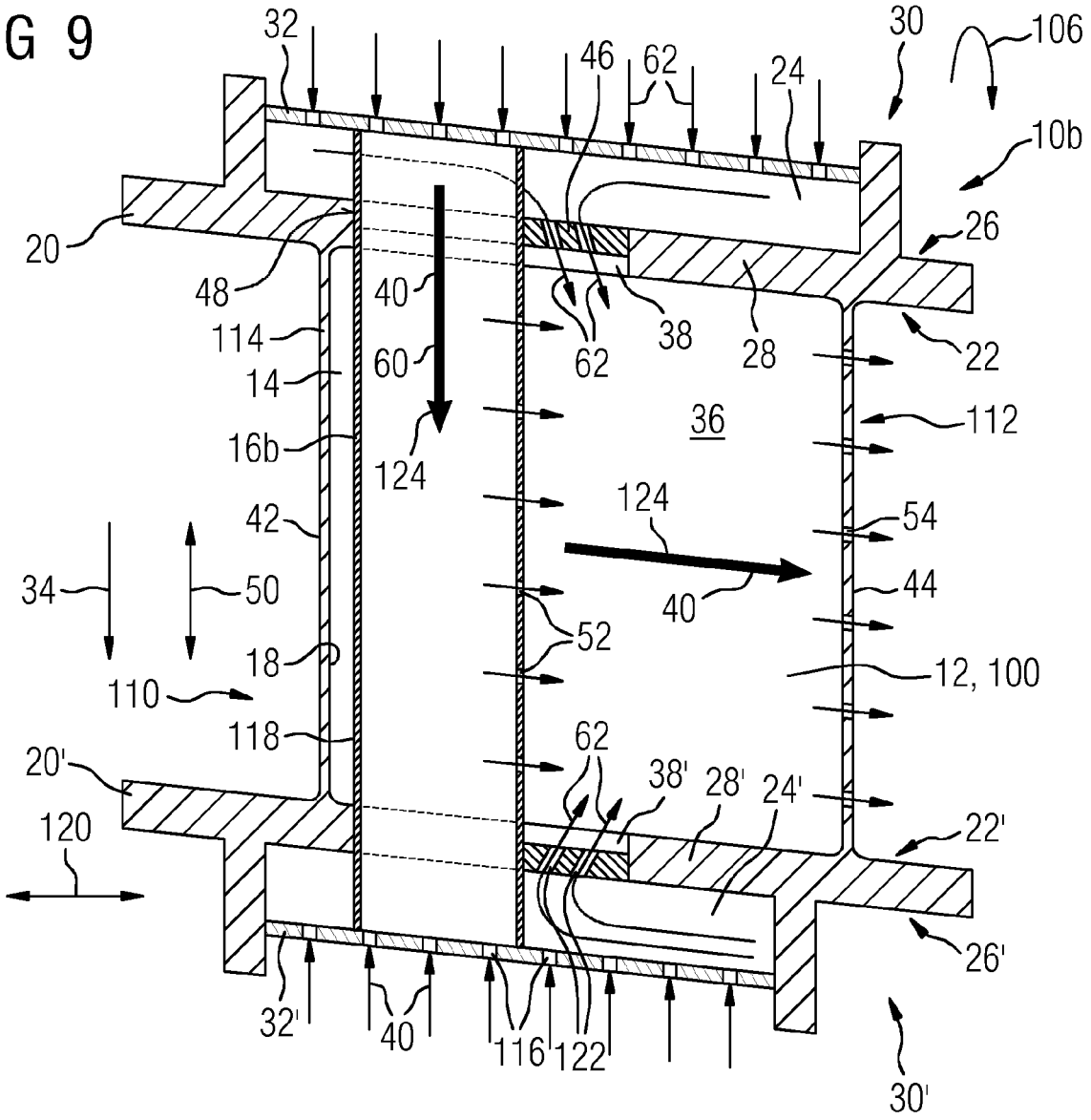

In FIG. 9 a cross section through a turbine assembly 10*b* analogously formed as in FIGS. 1 to 5 with an alternatively embodied impingement tube 16*b* is shown. The embodiment from FIG. 9 differs in regard to the embodiment according to FIGS. 1 to 5 in that the impingement tube 16*b* extends in span wise direction 34 completely through a first cooling chamber 24 from a first or an outer platform 20 to a first cover plate 32 and completely through a second cooling chamber 24' from a second or inner platform 20' to a second cover plate 32'. Furthermore, the impingement tube 16*b* ends at both its radial or longitudinal ends at the first and second cover plate 32, 32' in a hermetically sealed manner.

It would be also possible that the impingement tube extends in span wise direction completely through a second cooling chamber from a second platform to a second cover plate. Thus, the impingement tube ends at its second radial or longitudinal end at the second cover plate in a hermetically sealed manner. The impingement tube extends through the inner platform and terminates at its first radial or longitudinal end at the outer platform. A first radial or longitudinal end of the impingement tube is sealed at the wall segment of the outer platform or via a sealing means in respect to the first cooling chamber (not shown).

In general it would be also possible to provide only one of the wall segments of the inner or outer platform with an entry aperture to allow the flow communication of the cooling medium from the cooling chambers in the sub-cavity. Hence, cooling medium entering one of the cooling chambers of one of the platforms is not fed to the sub-cavity. To provide an outlet for the cooling medium to exit the respective cooling chamber it may be provided with an exit aperture to feed the cooling medium directly into the gas path at an edge of the respective platform (not shown).

Further it would be also feasible to provide a first stream of cooling medium to the impingement tube from a first platform and to feed the second stream of cooling medium via the cooling chamber to the sub-cavity from the other platform (not shown). To provide an outlet for the cooling medium to exit the cooling chamber without the flow communication (entry aperture) with the sub-cavity it may be provided with an exit aperture to feed the cooling medium directly into the gas path at an edge of the respective platform (not shown).

Although the invention is illustrated and described in detail by the preferred embodiments, the invention is not limited by the examples disclosed, and other variations can be derived therefrom by a person skilled in the art without departing from the scope of the invention.

The invention claimed is:

1. A turbine assembly comprising:

a basically hollow aerofoil comprising at least a main cavity with at least an impingement tube, which is insertable inside the main cavity of the basically hollow aerofoil and is used for impingement cooling of at least an inner surface of the main cavity, at least one platform, which is arranged at a radial end of the basically hollow aerofoil, and at least one cooling chamber used for cooling of the at least one platform and which is arranged relative to the basically hollow aerofoil on an opposed side of the at least one platform and wherein the at least one cooling chamber is limited at a first radial end by at least one wall segment of the at least one platform and at an opposed radial second end from at least one cover plate, wherein the impingement tube extends in a span wise direction at least completely through the at least one cooling chamber from the at least one platform to the at least one cover plate, wherein the impingement tube restricts a sub-cavity of the main cavity bounded by the inner surface of the main cavity and an outer surface of the impingement tube, wherein the at least one wall segment of the at least one platform comprises at least one entry aperture for a cooling medium to enter through the at least one entry aperture from the at least one cooling chamber of the at least one platform into the sub-cavity of the basically hollow aerofoil, and wherein the at least one entry aperture is covered by an orifice plate comprising at least one orifice therethrough for controlling a flow of the cooling medium flowing through the at least one entry aperture and directly into the sub-cavity upon exiting the at least one orifice.

2. The turbine assembly according to claim 1, wherein the basically hollow aerofoil comprises a leading edge and a trailing edge, and wherein the impingement tube is located towards the leading edge of the basically hollow aerofoil and the sub-cavity of the main cavity is located viewed in direction from the leading edge to the trailing edge downstream of the impingement tube.

3. The turbine assembly according to claim 1, wherein the at least one entry aperture in the at least one wall segment of the at least one platform is an insertion aperture through which the impingement tube extends from the at least one cooling chamber of the at least one platform to the main cavity of the basically hollow aerofoil.

4. The turbine assembly according to claim 1, wherein the at least one entry aperture in the at least one wall segment of the at least one platform is a separate entry aperture from an insert aperture through which the impingement tube extends from the at least one cooling chamber of the at least one platform to the main cavity of the basically hollow aerofoil.

5. The turbine assembly according to claim 1, wherein the impingement tube ends at the at least one cover plate in a hermetically sealed manner.

6. The turbine assembly according to claim 1, wherein the impingement tube extends completely through a span of the basically hollow aerofoil.

7. The turbine assembly according to claim 1, further comprising:

at least one further platform, wherein the at least one platform and the at least one further platform are arranged at opposed radial ends of the basically hollow aerofoil and wherein the at least one further platform comprises at least one further wall segment that comprises at least one further entry aperture for the cooling medium to enter through the at least one further entry aperture from at least one further cooling chamber of the at least one further platform into the sub-cavity of the basically hollow aerofoil.

8. The turbine assembly according to claim 1, wherein the impingement tube comprises at least one communicating aperture to allow a flow communication of cooling medium between the impingement tube and the sub-cavity.

9. The turbine assembly according to claim 1, wherein the basically hollow aerofoil is a turbine blade or vane.

10. The turbine assembly according to claim 1, wherein the basically hollow aerofoil comprises a trailing edge and wherein the trailing edge has exit apertures to allow a merged stream of cooling medium from the at least one cooling chamber, from the impingement tube and from the sub-cavity to exit the basically hollow aerofoil.

11. The turbine assembly according to claim 1, wherein the at least one cover plate of the at least one cooling chamber of the at least one platform is divided by the impingement tube in at least two sections.

12. The turbine assembly according to claim 1 wherein the turbine assembly is cooled by a first stream of cooling medium which is fed to the impingement tube and by a second stream of cooling medium which is fed first to the at least one cooling chamber and thereafter through the at least one entry aperture to the sub-cavity in series.

13. A gas turbine engine comprising:

a plurality of turbine assemblies, wherein at least one turbine of the plurality of turbine assemblies is arranged according to claim 1.

14. The turbine assembly according to claim 1, wherein the orifice plate is disposed across the at least one entry aperture and the at least one orifice comprises an inlet on a side of the orifice plate facing the at least one cooling chamber and an outlet on a side of the orifice plate facing the sub-cavity.

15. The turbine assembly according to claim 1, wherein the orifice plate is disposed across the at least one entry aperture and the at least one orifice comprises an inlet on a side of the orifice plate facing in a first radial direction and an outlet on a side of the orifice plate facing in a second radial direction opposite the first radial direction.

16. The turbine assembly according to claim 1, wherein the orifice plate is flat.

17. The turbine assembly according to claim 1, wherein the at least one orifice comprises an outlet configured to direct the cooling medium radially inwardly into the sub-cavity.

18. The turbine assembly according to claim 1, wherein the at least one orifice comprises an outlet disposed on a same radial side of the sub-cavity as an inlet to the at least one orifice.

* * * * *